US009044957B2

(12) United States Patent
Owaki et al.

(10) Patent No.: US 9,044,957 B2
(45) Date of Patent: Jun. 2, 2015

(54) LIQUID EJECTING APPARATUS

(71) Applicant: Seiko Epson Corporation, Tokyo (JP)

(72) Inventors: Hiroshige Owaki, Nagano-ken (JP); Hiroyuki Hagiwara, Nagano-ken (JP); Haruhisa Uezawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/048,366

(22) Filed: Oct. 8, 2013

(65) Prior Publication Data

US 2014/0104348 A1 Apr. 17, 2014

(30) Foreign Application Priority Data

Oct. 12, 2012 (JP) ..... 2012-227347

(51) Int. Cl.
*B41J 2/175* (2006.01)
*B41J 2/18* (2006.01)

(52) U.S. Cl.
CPC ..... *B41J 2/17596* (2013.01); *B41J 2/17563* (2013.01); *B41J 2/18* (2013.01)

(58) Field of Classification Search
USPC ..... 347/84–85, 89, 93
See application file for complete search history.

(56) References Cited

U.S. PATENT DOCUMENTS

| | | | | |
|---|---|---|---|---|
| 4,380,770 | A * | 4/1983 | Maruyama | 347/29 |
| 5,561,448 | A * | 10/1996 | Kaneko et al. | 347/29 |
| 5,771,052 | A * | 6/1998 | Hine et al. | 347/42 |
| 6,152,559 | A * | 11/2000 | Kojima | 347/89 |
| 6,231,174 | B1 * | 5/2001 | Haigo | 347/89 |
| 7,597,434 | B2 * | 10/2009 | Nitta et al. | 347/89 |
| 7,841,708 | B2 * | 11/2010 | Morgan et al. | 347/85 |
| 8,100,500 | B2 * | 1/2012 | Bansyo | 347/19 |
| 2008/0055378 | A1 * | 3/2008 | Drury et al. | 347/92 |
| 2012/0062659 | A1 | 3/2012 | Tsubaki | |

FOREIGN PATENT DOCUMENTS

JP 2012-056248 A 3/2012

* cited by examiner

*Primary Examiner* — Anh T. N. Vo

(57) ABSTRACT

A liquid ejecting apparatus includes a liquid ejecting head that ejects liquid in a manifold as liquid droplets from a nozzle opening; a supply path that supplies the liquid to the manifold; a pump unit that is disposed in the supply path and pumps the liquid; and a discharge path that discharges the liquid from the manifold, wherein a flow path resistance of the discharge path from the manifold is smaller than a flow path resistance of the supply path from the pump unit to the manifold.

12 Claims, 10 Drawing Sheets

LIQUID EJECTING APPARATUS

CROSS REFERENCE TO RELATED APPLICATIONS

This application claims priority to Japanese Patent Application No. 2012-227347 filed on Oct. 12, 2012. The entire disclosure of Japanese Patent Application No. 2012-227347 is incorporated herein by reference.

BACKGROUND

1. Technical Field

The present invention relates to liquid ejecting apparatuses having a liquid ejecting head that ejects liquid from nozzle openings, and more specifically to ink jet recording apparatuses having an ink jet recording head that ejects ink as liquid droplets.

2. Related Art

Liquid ejecting apparatuses having a liquid ejecting head that ejects liquid include ink jet recording apparatuses having an ink jet recording head that generates a pressure in flow paths by using pressure generating means and ejects ink droplets from nozzle openings that communicate with the flow paths.

Such an ink jet recording head has a problem of ejection failure such as clogging of nozzle openings due to thickening of ink, sedimentation of ink components and containment of air bubbles. JP-A-2012-56248 discloses a liquid ejecting apparatus including a supply path that supplies ink stored in a liquid storing unit to a manifold which is a common liquid chamber for all the flow paths that communicate with the respective nozzle openings of an ink jet recording head, and a discharge path that discharges ink which is thickened and contains sediments of ink components and air bubbles from the manifold of the ink jet recording head to the outside.

However, in a configuration in which ink is supplied from the outside to the ink jet recording head and is discharged from the ink jet recording head to the outside, the consumption of ink ejected at a time differs between when ink droplets are ejected from all the nozzle openings and when ink droplets are ejected from one nozzle opening. This causes a pressure change in the manifold and leads to a problem in that the weight of ejected ink droplets varies.

Such a problem is not limited to the ink jet recording apparatuses and exists in the liquid ejecting apparatuses that eject liquid other than ink.

SUMMARY

An advantage of some aspects of the invention is that the liquid ejecting apparatus that is capable of preventing the weight of ejected liquid droplets from varying depending on the consumption of liquid ejected at a time, and preventing uneven application of the liquid is provided.

According to an aspect of the invention, a liquid ejecting apparatus includes a liquid ejecting head that ejects liquid in a manifold as liquid droplets from a nozzle opening; a supply path that supplies the liquid to the manifold; a pump unit that is disposed in the supply path and pumps the liquid; and a discharge path that discharges the liquid from the manifold, wherein a flow path resistance of the discharge path from the manifold is smaller than a flow path resistance of the supply path from the pump unit to the manifold. Accordingly, since the flow path resistance of the discharge path is decreased, a pressure in the manifold can be prevented from varying depending on the amount of liquid ejected at a time. As a result, the difference in the weight of ejected liquid can be reduced, thereby preventing uneven application of the liquid. Further, since the liquid is pumped by using the pump unit, the liquid can be supplied under a high pressure.

In the above aspect, a filter that traverses the supply path is preferably disposed in the supply path at a position between the pump unit and the manifold. With use of the filter, the flow path resistance of the supply path becomes larger than the flow path resistance of the discharge path.

Further, the flow path resistance may be adjusted by adjusting the amount of cross-sectional area of the supply path and the discharge path.

It is preferable that the liquid ejecting apparatus further includes a liquid storing unit, wherein the pump unit pumps the liquid stored in the liquid storing unit via the supply path, and the discharge path discharges the liquid from the manifold to the liquid storing unit. Accordingly, a circulation flow path can be formed.

It is preferable that the liquid ejecting apparatus further includes a supply liquid storing unit, wherein the pump unit pumps the liquid stored in the supply liquid storing unit via the supply path.

It is preferable that the liquid ejecting apparatus further includes a discharge liquid storing unit, wherein the discharge path discharges the liquid from the manifold to the discharge liquid storing unit.

It is preferable that the supply liquid storing unit and the discharge liquid storing unit are connected with each other. Accordingly, a circulation flow path can be formed.

It is preferable that the liquid ejecting apparatus further includes a plurality of liquid ejecting heads, wherein the supply path that supplies the liquid from the pump unit to the liquid ejecting head is divided into branches. With this configuration, the liquid can be supplied to a plurality of liquid ejecting heads by using one pump unit, thereby eliminating the need of a plurality of pump units and reducing the cost. Further, a difference in the pressure in the manifolds of the plurality of liquid ejecting heads can be reduced, thereby preventing the weight of liquid ejected from the plurality of liquid ejecting heads from varying.

It is preferable that pressure adjustment of a liquid meniscus at the nozzle opening is performed by using a water head difference between a liquid ejection surface to which the nozzle opening is open and the liquid storing unit. With this configuration, pressure adjustment can be performed without a negative pressure pump or the like, thereby reducing the cost.

BRIEF DESCRIPTION OF THE DRAWINGS

The invention will be described with reference to the accompanying drawings, wherein like numbers reference like elements.

DESCRIPTION OF EXEMPLARY EMBODIMENTS

The invention will be described below in detail based on embodiments.

First Embodiment

Figure 1:
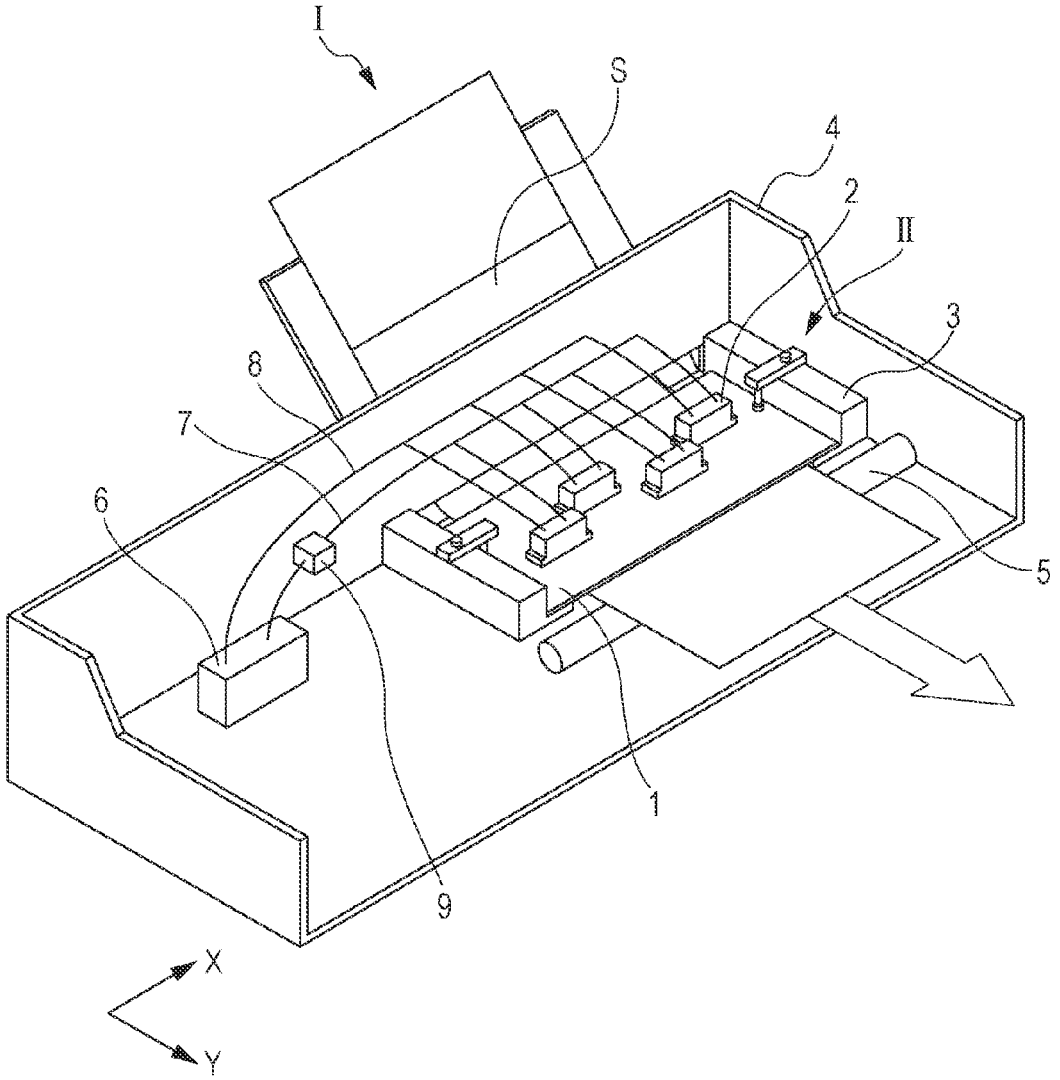
FIG. 1 is a perspective view which shows a schematic configuration of a recording apparatus according to a first embodiment.
Figure 2:
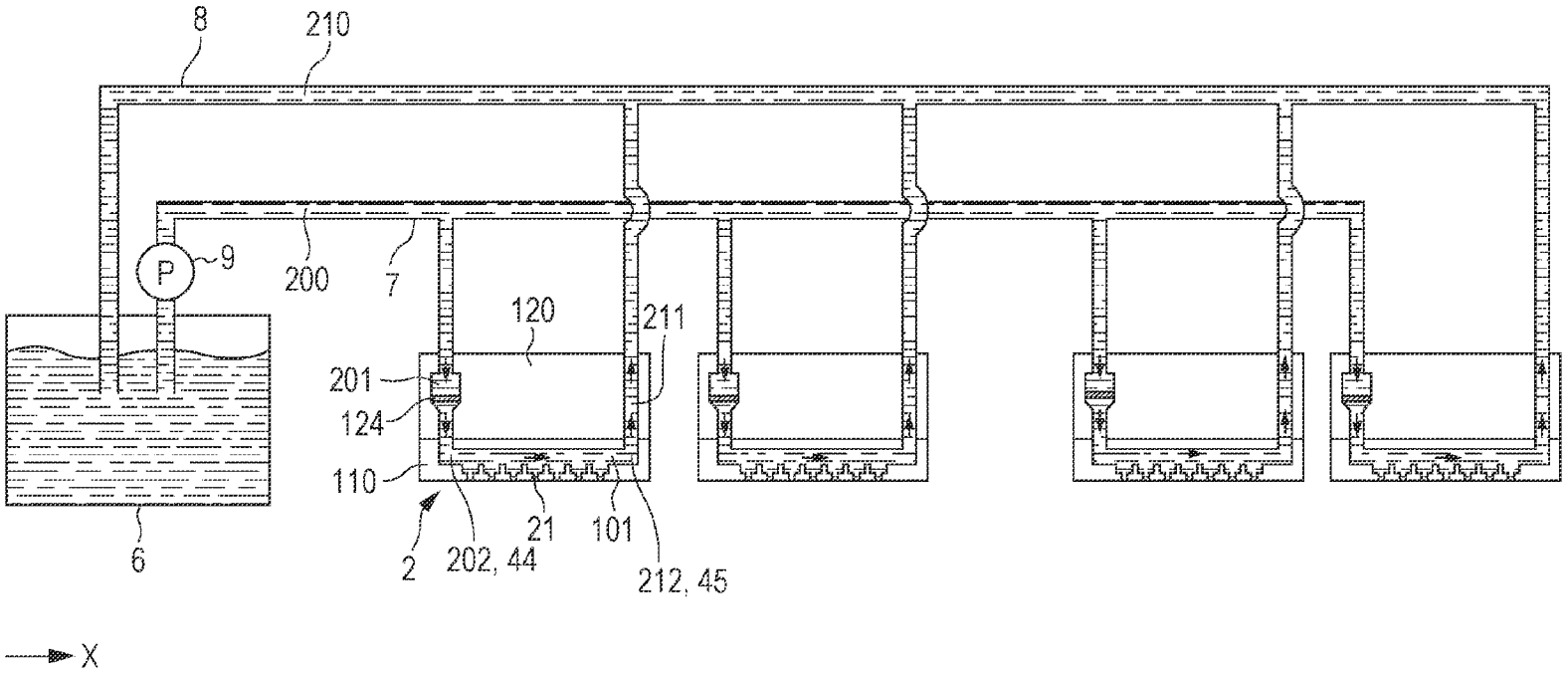
FIG. 2 is a sectional view which shows a schematic configuration of the recording apparatus according to the first embodiment.

FIG. 1 is a perspective view which shows a schematic configuration of an ink jet recording apparatus which is an example of liquid ejecting apparatus according to a first embodiment. FIG. 2 is a sectional view which shows a schematic configuration of the ink jet recording apparatus.

As shown in FIG. 1, an ink jet recording apparatus I which is an example of liquid ejecting apparatus of this embodiment is a so-called line-type ink jet recording apparatus in which a head unit II is fixedly attached on an apparatus body 4 and has a plurality of ink jet recording heads 2 so that printing is performed when a recording medium such as a recording sheet S is transported in a transporting direction.

The head unit II includes a base plate 1 and the plurality of ink jet recording heads 2 that are held by the base plate 1. A nozzle plate which is an ink ejection surface of the ink jet recording heads 2 is provided on one side of the base plate 1. The base plate 1 is fixedly attached on the apparatus body 4 via a frame member 3.

A sheet feeding roller 5 is disposed in the apparatus body 4. The sheet feeding roller 5 feeds the recording sheet S such as a sheet of paper which is fed to the apparatus body 4 so that the recording sheet S passes on the side of the ink ejection surface of the ink jet recording heads 2. In the head unit II, four ink jet recording heads 2 are arranged in a direction which is perpendicular to the transporting direction of the recording sheet S. An arrangement direction of nozzle openings (first direction X) is an arrangement direction of the four ink jet recording heads 2, which will be described in detail later.

Further, in the ink jet recording apparatus I, a liquid storing unit 6 such as an ink tank that stores ink is fixedly attached on the apparatus body 4. The liquid storing unit 6 is connected to a supply tube 7 that supplies ink to the ink jet recording heads 2 and a discharge tube 8 that discharges (recovers) ink from the ink jet recording heads 2.

The supply tube 7 and the discharge tube 8 are made of a tubular member such as a flexible tube and have a first supply path 200 for supplying ink and a first discharge path 210 for discharging ink, respectively. Further, a pump unit 9 such as a pump is disposed at a position on the supply tube 7 so as to pump ink from the liquid storing unit 6 to the ink jet recording heads 2.

In this embodiment, as shown in FIG. 2, the supply tube 7 (first supply path 200) is divided into branches at downstream to the pump unit 9 so that ink is pressurized by a single pump unit 9 and is supplied to the plurality of ink jet recording heads 2.

Then, ink in the liquid storing unit 6 is supplied to the ink jet recording heads 2 via the first supply path 200, and ink which is not ejected from the nozzle openings is recovered to the liquid storing unit 6 via the first discharge path 210. In this embodiment, ink which is stored in the liquid storing unit 6 is supplied to the ink jet recording heads 2 via the first supply path 200, and ink which is discharged from the ink jet recording heads 2 is discharged into the liquid storing unit 6 via the first discharge path 210. Accordingly, the first supply path 200 and the first discharge path 210 form part of a circulation flow path through which ink flows between the liquid storing unit 6 and the ink jet recording heads 2.

Figure 3:
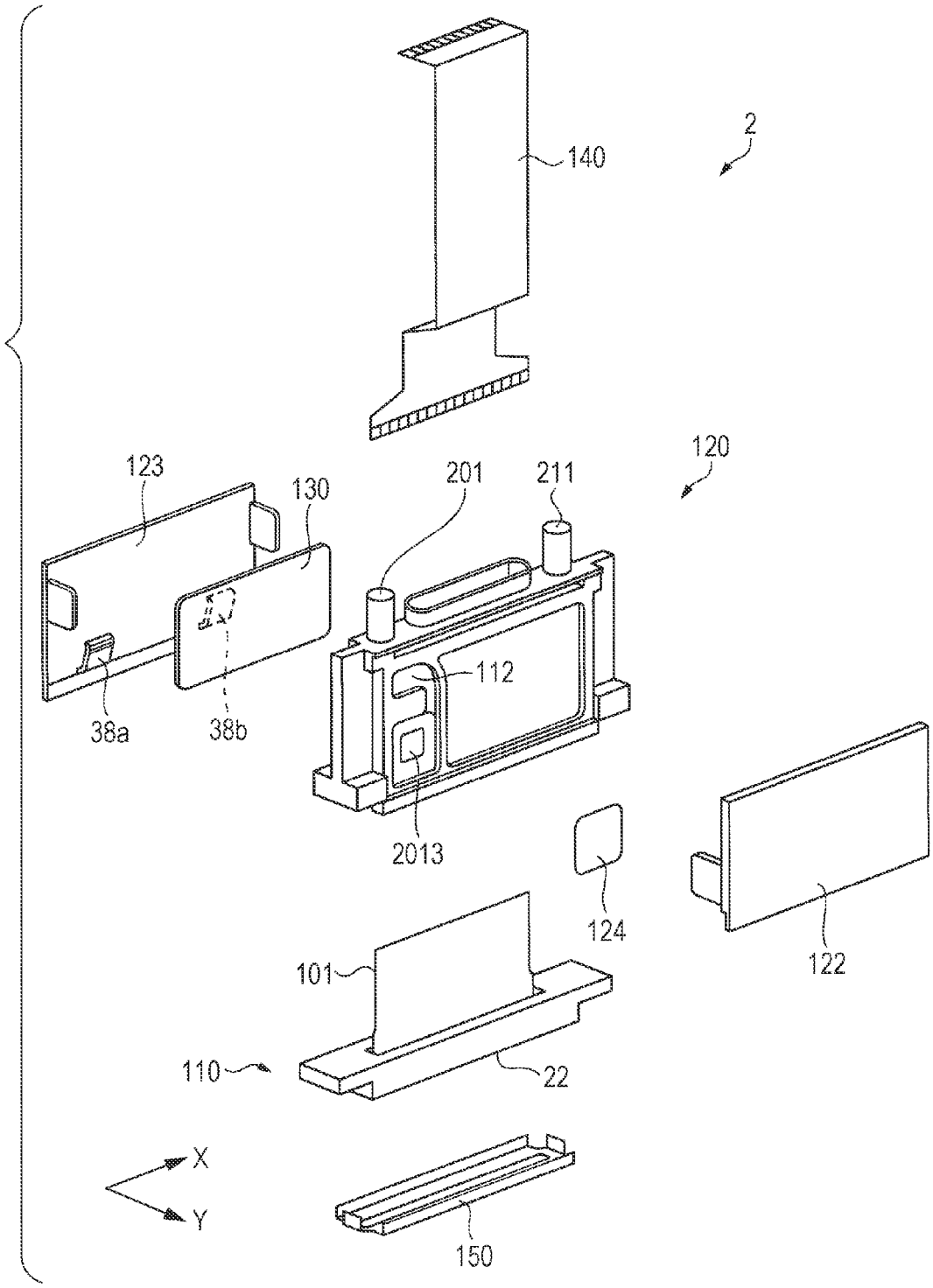
FIG. 3 is an exploded perspective view of a recording head according to the first embodiment.
Figure 4:
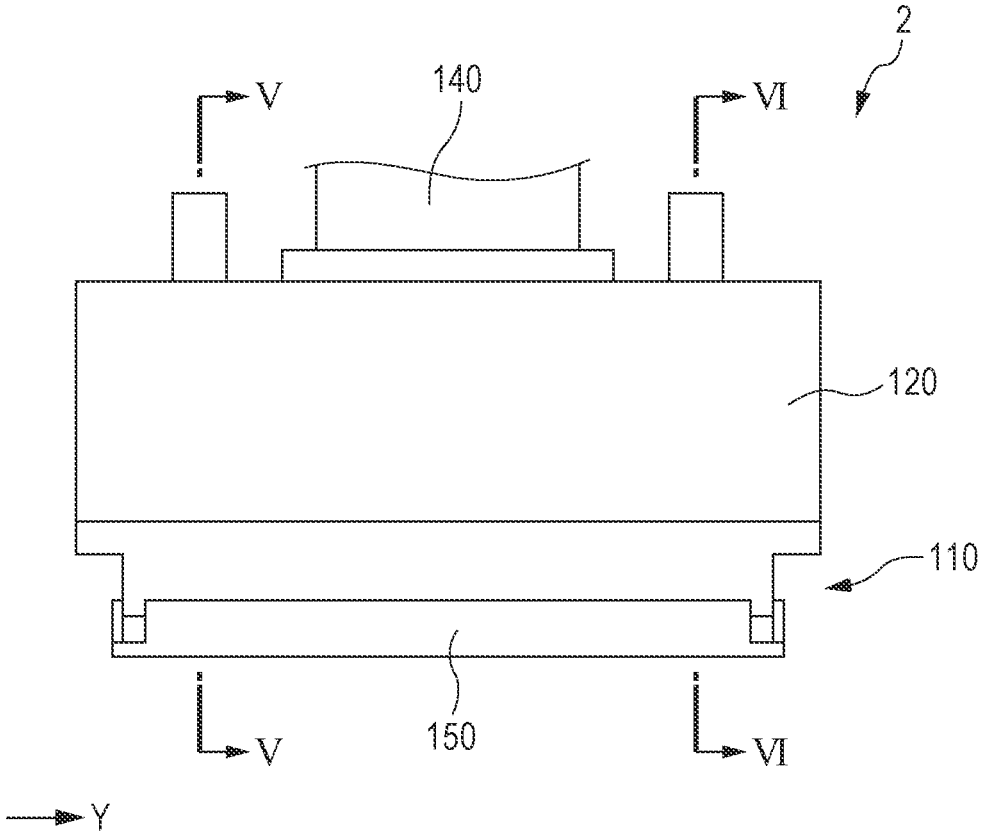
FIG. 4 is a plan view of the recording head according to the first embodiment.
Figure 5:
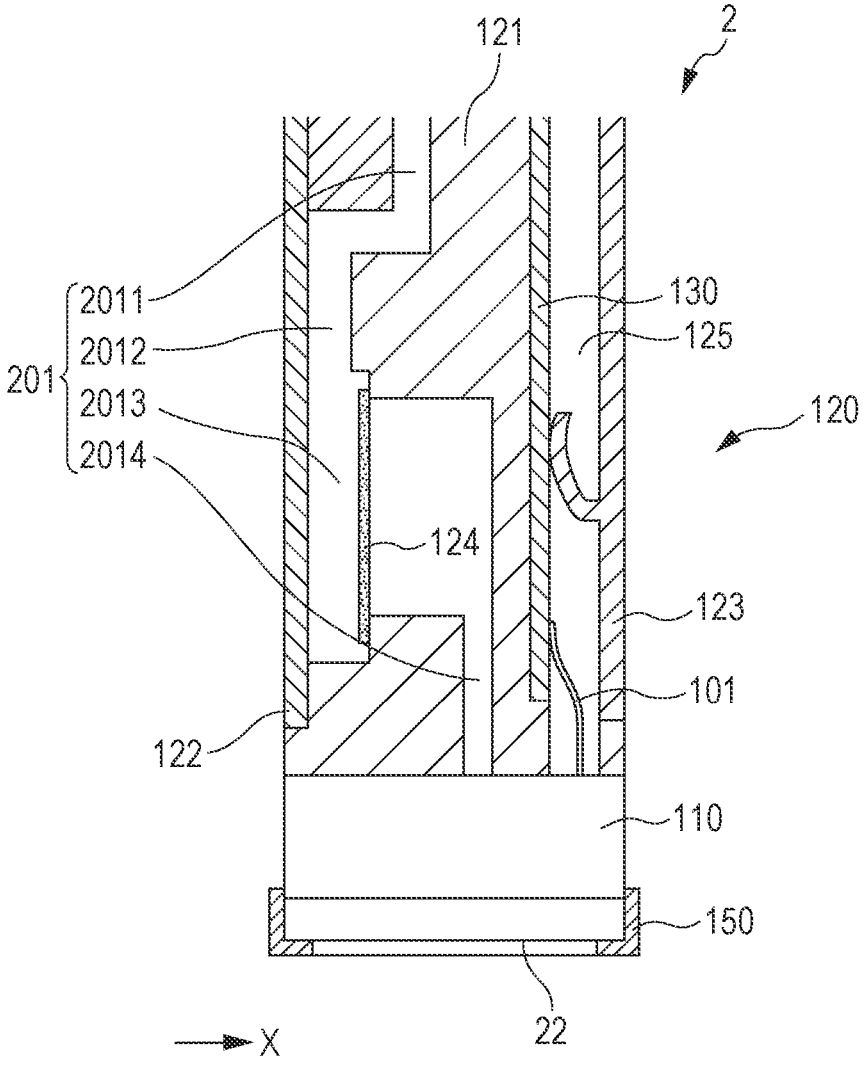
FIG. 5 is a sectional view of the recording head according to the first embodiment.
Figure 6:
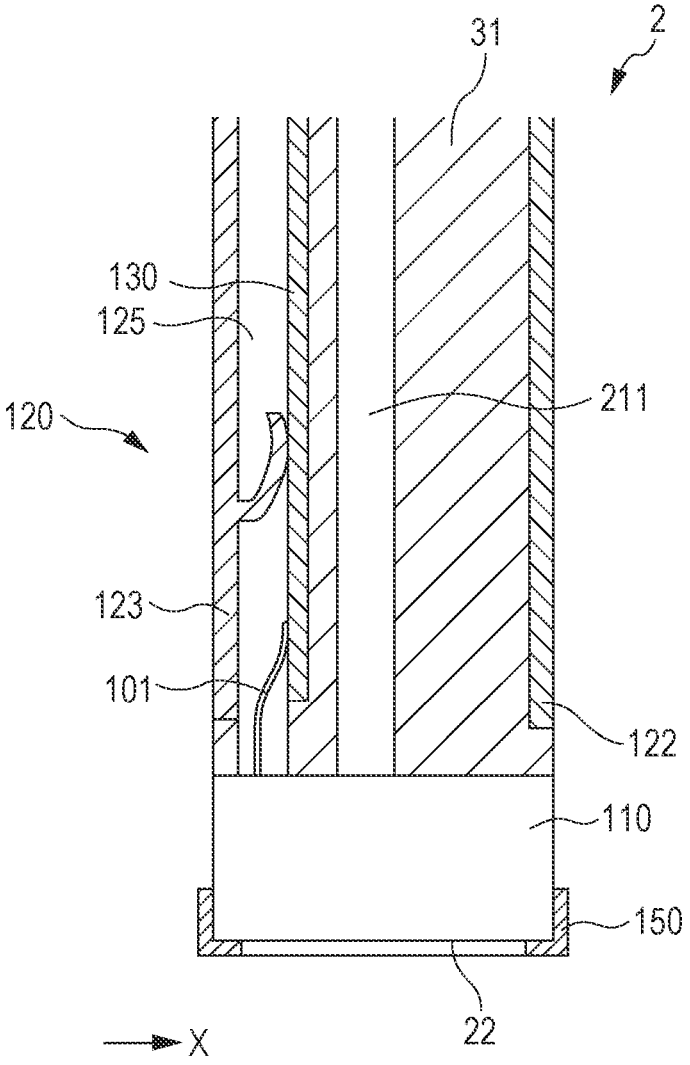
FIG. 6 is a sectional view of the recording head according to the first embodiment.

An example of the ink jet recording head 2 which is mounted on the ink jet recording apparatus I will be described in detail below. FIG. 3 is an exploded perspective view of the ink jet recording head 2 which is an example of liquid ejecting head according to the first embodiment. FIG. 4 is a plan view of the ink jet recording head 2. FIG. 5 is a sectional view of an essential part of the ink jet recording head 2 taken along the line V-V of FIG. 4. FIG. 6 is a sectional view of an essential part of the ink jet recording head 2 taken along the line VI-VI of FIG. 4.

As illustrated, the ink jet recording head 2 which is an example of liquid ejecting head of this embodiment includes a head body 110 that ejects ink droplets as an example of liquid, a flow path member 120 that supplies ink to the head body 110, a circuit substrate 130 that is held by the flow path member 120, and a wiring substrate 140 that is connected to the circuit substrate 130.

The head body 110, which will be described in detail later, is configured to eject the supplied ink as ink droplets from the nozzle openings and includes flow paths that communicate with nozzle openings and pressure generating means such as a piezoelectric actuator that generates pressure change in ink in the flow paths.

The head body 110 includes a drive wiring 101 which is a flexible wiring member whose one end is connected to the piezoelectric actuator (pressure generating means). The drive wiring 101 may include, for example, a drive circuit (drive IC) that drives the piezoelectric actuator (pressure generating means). That is, the drive wiring 101 may be a COF substrate on which a drive circuit is mounted.

A cover head 150 is fixedly attached on the liquid ejection surface 22 so as to protect the nozzle openings of the head body 110 which are open to the liquid ejection surface 22.

The flow path member 120 includes a flow path body 121, and a first cover 122 and a second cover 123 which are disposed on each side of the flow path body 121.

Further, the flow path member 120 includes a second supply path 201 that communicates with the first supply path 200 of the liquid storing unit 6 (see FIG. 1) that stores ink as an example of liquid so as to supply ink to the head body 110 and a second discharge path 211 that discharges ink from the head body 110 to the first discharge path 210.

The second supply path 201 of the ink jet recording head 2 includes an introduction port 2011 that communicates with the first supply path 200, a first flow path 2012 that communicates with the introduction port 2011, a filter chamber 2013 that communicates with the first flow path 2012, a second flow path 2014 that connects the filter chamber 2013 to the head body 110.

As shown in FIG. 5, the first flow path 2012 and the filter chamber 2013 are formed as a channel, one side of which is open to the surface of the flow path body 121 (on the side of the first cover 122). The openings of the first flow path 2012 and the filter chamber 2013 are closed by the first cover 122.

The second flow path 2014 has one end which is connected to the filter chamber 2013 and the other end which is connected to the flow path of the head body 110.

Further, a filter 124 is disposed in the filter chamber 2013 so as to filter out foreign substances such as dust and air bubbles contained in the ink. The filter 124 is configured to filter out foreign substances such as dust and air bubbles contained in the ink which is an example of liquid and may be, for example, a sheet member having a plurality of micropores formed by finely braided metal or resin fibers, or a metal or resin plate member having a plurality of micropores which penetrate the plate member. The filter 124 may be made of a non-woven fiber or any other materials.

The flow path body 121 also includes a recess 125 that is open to the surface of the flow path body 121 on the side of the second cover 123 which is opposite to the first cover 122 where the first flow path 2012 and the filter chamber 2013 are open. The circuit substrate 130 is inserted into the recess 125 of the flow path body 121. Then, the circuit substrate 130 inserted into the recess 125 is held between the flow path body 121 and the second cover 123 that closes the opening of the recess 125.

The circuit substrate 130 is formed by a printed substrate on which electronic elements and wiring, which are not shown in the figure, are provided. The circuit substrate 130 is electrically connected to the drive wiring 101 of the head body 110 and a wiring substrate 140, which is not shown in the figure. Accordingly, print signals from an external control circuit or the like are supplied as drive signals to the piezoelectric actuator, which will be described later, via the wiring substrate 140, the circuit substrate 130 and the drive wiring 101. Further, signals from the circuit substrate 130 (temperature information, which will be described later) are transmitted to the external control circuit or the like via the wiring substrate 140. The circuit substrate 130 may be either a flexible substrate or a rigid substrate, or a composite substrate made of a combination of a flexible substrate and a rigid substrate.

The circuit substrate 130 is held in the recess 125 of the flow path body 121 between the flow path body 121 and the second cover 123.

As shown in FIG. 6, the second discharge path 211 disposed in the flow path member 120 is configured to recover the ink which has been supplied to the head body 110 (manifold) back to the liquid storing unit 6. The second discharge path 211 is disposed on an end which is opposite to the second supply path 201 of the flow path member 120.

The second discharge path 211 penetrates a surface of the flow path member 120 on the side of the head body 110 and a surface opposite to the head body 110, as shown in FIG. 6.

In the ink jet recording head 2 of this embodiment, ink is supplied from the liquid storing unit 6 which is shown in FIG. 1 via the second supply path 201 in the flow path member 120 to the manifold in the head body 110, which will be described in detail later, so that inside of the path from the manifold to the nozzle openings is filled with ink. After that, the piezoelectric actuator is actuated in response to recording signals from the drive circuit or the like, thereby ejecting ink droplets from the nozzle openings. Further, ink which has been supplied in the manifold in the head body 110 is returned to the liquid storing unit 6 via the second discharge path 211 of the flow path member 120. That is, ink in the liquid storing unit 6 is supplied to the head body 110 via the first supply path 200 and the second supply path 201, and is then discharged from the head body 110 to the liquid storing unit 6 via the second discharge path 211 and the first discharge path 210.

Figure 7:
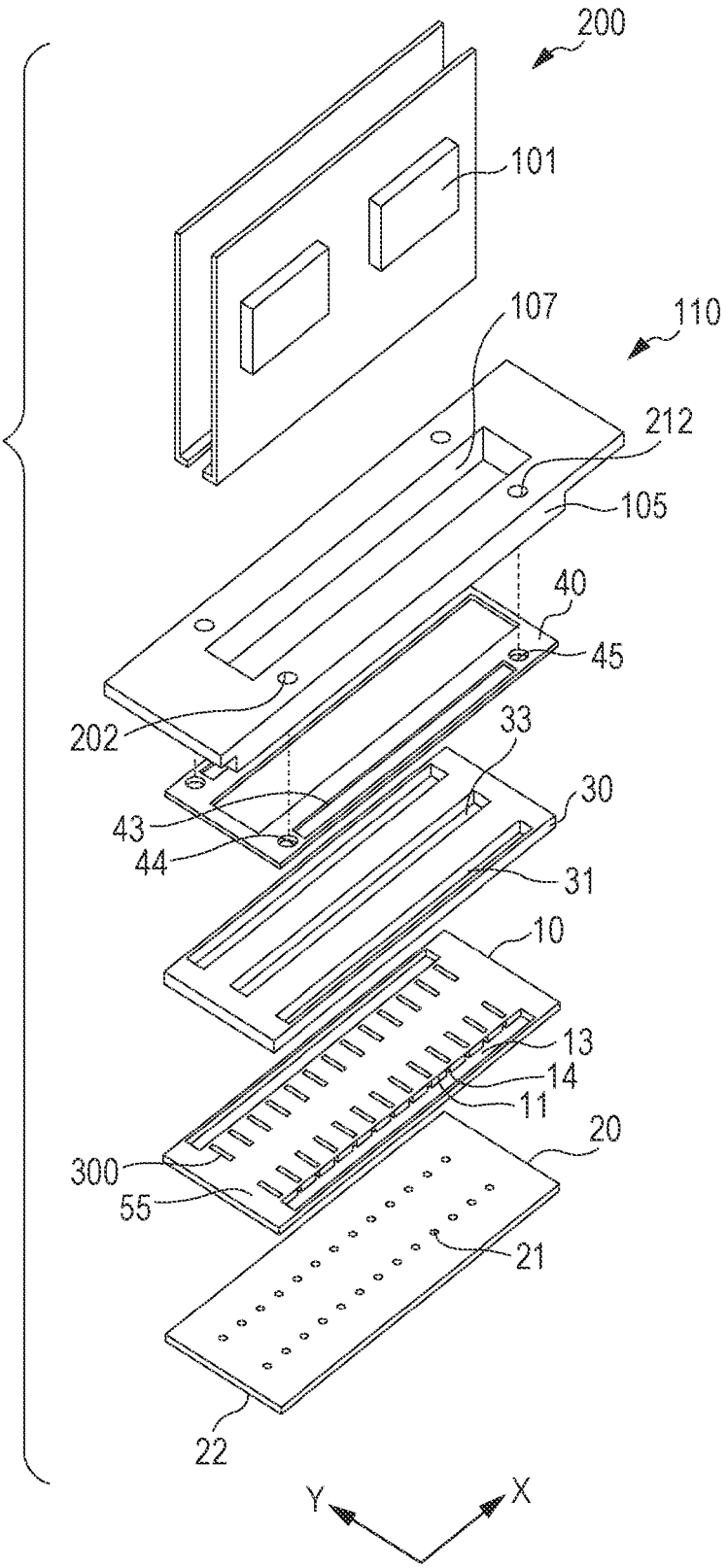
FIG. 7 is an exploded perspective view of a head body according to the first embodiment.
Figure 8:
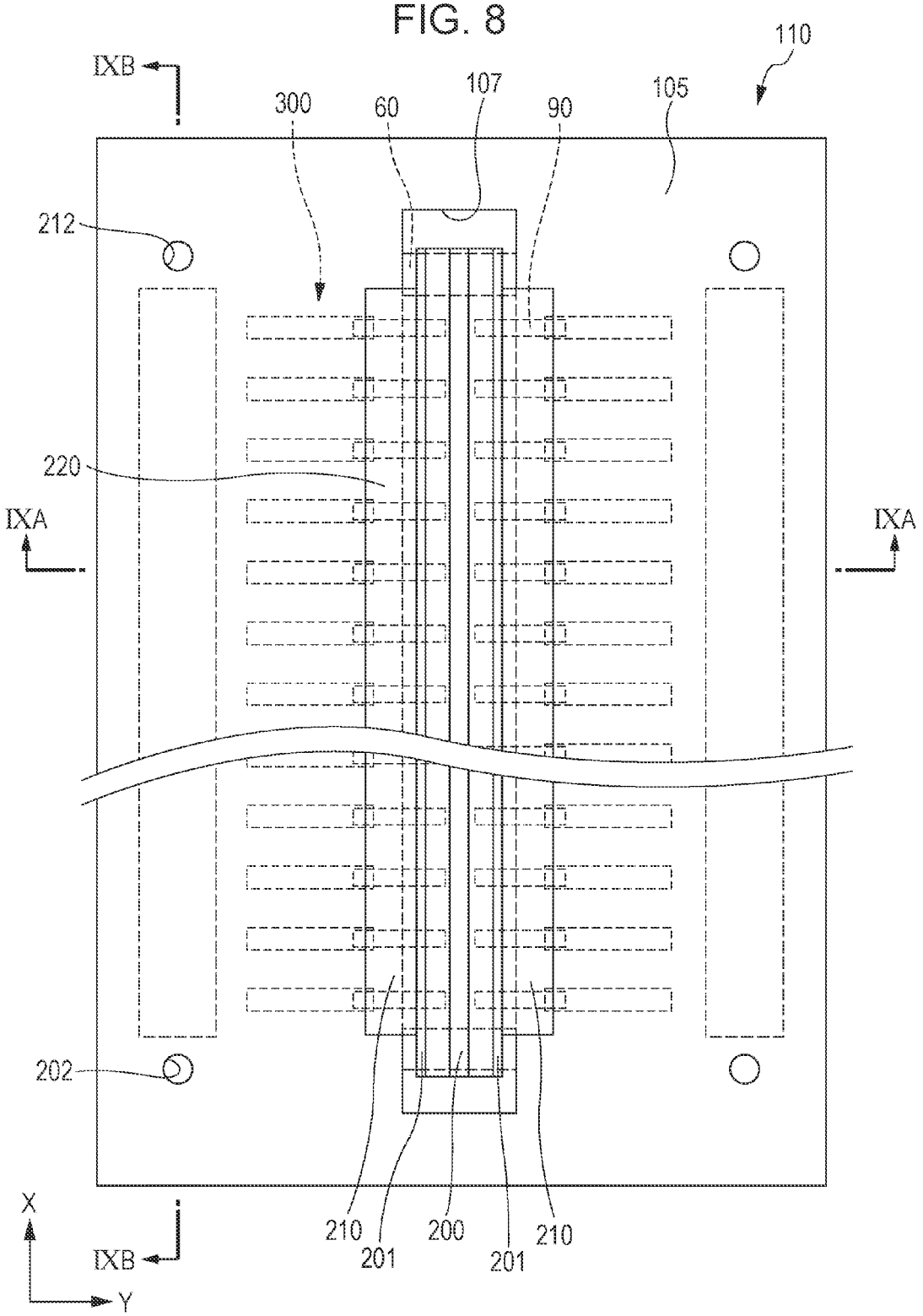
FIG. 8 is a plan view of the head body according to the first embodiment.
Figure 9A:
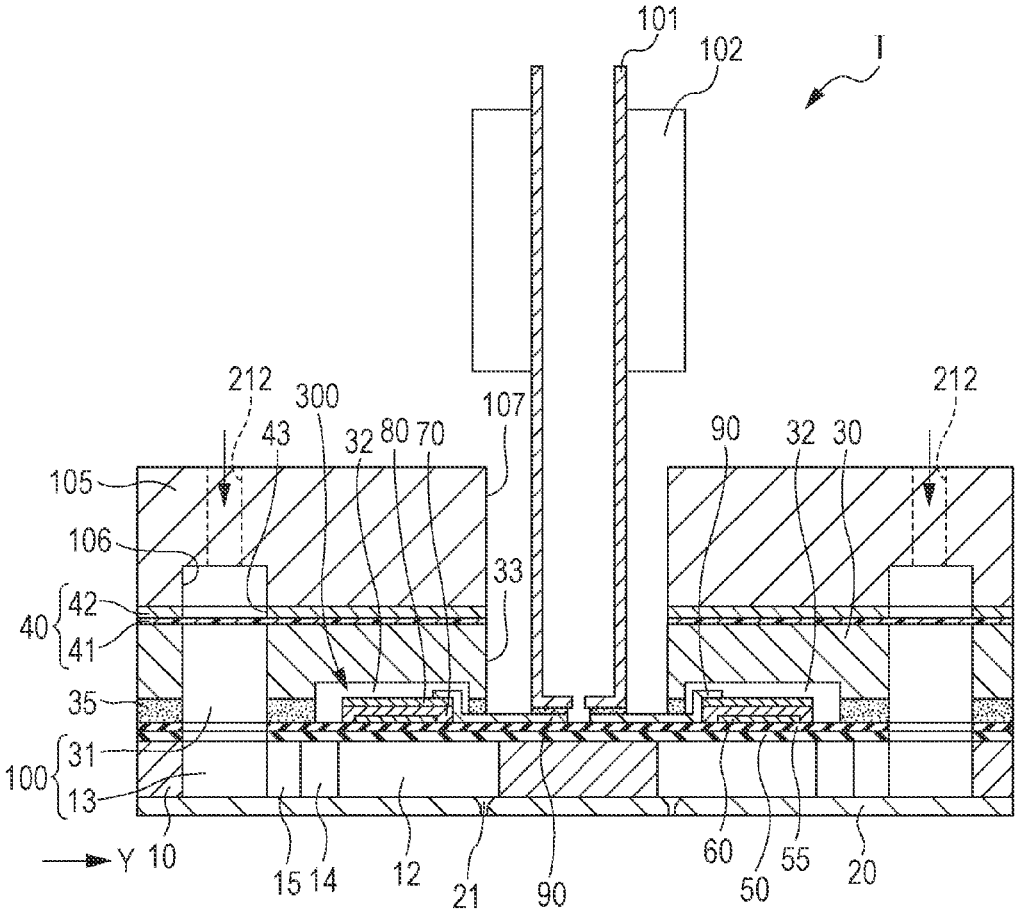
FIGS. 9A and 9B are sectional views of the head body according to the first embodiment.
Figure 9B:
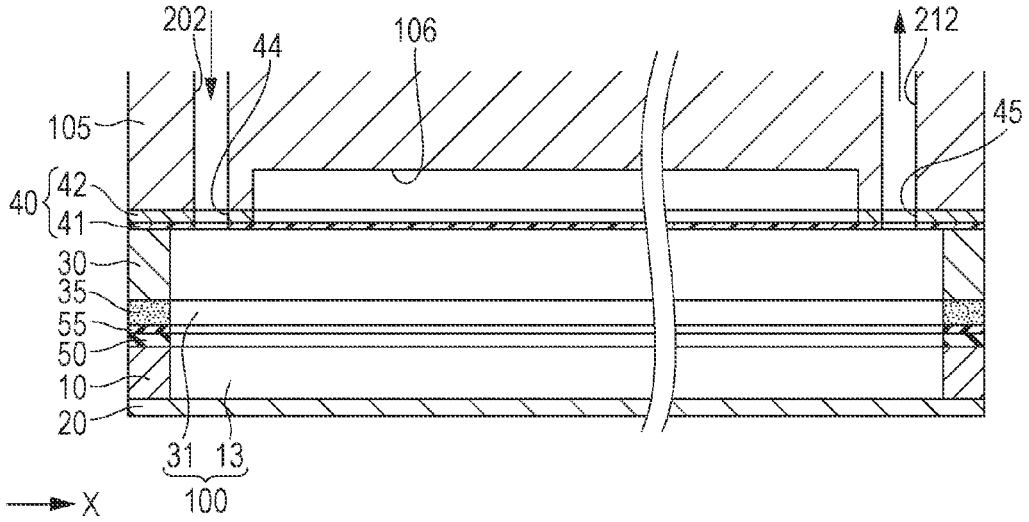

An example of the head body 110 of this embodiment will be described in detail with reference to FIGS. 7 to 9B. FIG. 7 is an exploded perspective view of the head body 110 according to the first embodiment of the invention. FIG. 8 is a plan view of the head body 110. FIG. 9A and FIG. 9B are sectional views of the head body 110 taken along the line IXA-IXA and IXB-IXB of FIG. 8, respectively.

As illustrated, a flow path forming substrate 10 constitutes the ink jet recording head 2 which is an example of the liquid ejecting head of this embodiment. On the flow path forming substrate 10, a plurality of pressure generating chambers 12 separated by walls 11 are arranged side by side in the arrangement direction of a plurality of nozzle openings 21 that eject ink of the same color. This direction is hereinafter referred to as an arrangement direction of the pressure generating chamber 12 or the first direction X. Moreover, a plurality of rows (in this embodiment, two rows) of the pressure generating chambers 12 which are arranged side by side in the first direction X are disposed on the flow path forming substrate 10. The arrangement direction of the rows of the pressure generating chambers 12 in which the pressure generating chambers 12 are arranged in the first direction X is hereinafter referred to as a second direction Y.

Further, communication sections 13 are formed on the outside of the pressure generating chambers 12 in the second direction Y such that the communication sections 13 communicate with each of the pressure generating chambers 12 via ink supply paths 14 and communication paths 15 which are provided for each of the pressure generating chamber 12. The communication sections 13 communicate with manifold sections 31 of the protective substrate 30, which will be described later, so as to form part of manifolds 100 which serve as a common ink chamber of the pressure generating chambers 12. The ink supply paths 14 have a width narrower than that of the pressure generating chambers 12 and keep a flow path resistance of ink flowing from the communication sections 13 into the pressure generating chambers 12 to be constant. In this embodiment, although the ink supply paths 14 are formed by narrowing the width of the flow path from one side, the ink supply path 14 may be formed by narrowing the width of the flow path from both sides. Alternatively, the ink supply path 14 may be formed by narrowing the thickness instead of the width of the flow path. The communication paths 15 are formed by providing the walls 11 on both sides of the pressure generating chambers 12 in the width direction with the walls 11 extending on the side of the communication sections 13 and separating spaces between the ink supply paths 14 and the communications sections 13. That is, the flow path forming substrate 10 has the ink supply paths 14 that have a cross-sectional area smaller than that of the pressure generating chambers 12 in the first direction X, and the communication paths 15 that communicate with the ink supply paths 14 and have a cross-sectional area larger than that of the ink supply paths 14 in the first direction X, which are separated by a plurality of walls 11. In this embodiment, the pressure generating chambers 12, the communication sections 13, the ink supply paths 14 and the communication paths 15 are provided on the flow path forming substrate 10 as the flow paths that communicate with the nozzle openings 21. In this embodiment, the pressure generating chambers 12, the communication sections 13, the ink supply paths 14, the communication paths 15 and the manifolds 100 (manifold sections 31), which will be described in detail later, are collectively referred to as downstream flow paths.

Further, a nozzles plate 20 is attached on an opening side of the flow path forming substrate 10 by an adhesive, heat-welded film and the like. The nozzle openings 21 that penetrate the nozzles plate 20 are formed in the vicinity of one end of the pressure generating chambers 12 which is opposite to the ink supply paths 14 in the second direction Y. In this embodiment, since two rows of the pressure generating chambers 12 are disposed on the flow path forming substrate 10, each ink jet recording head 2 has two nozzle rows in which the nozzle openings 21 are arranged side by side. Further, in this embodiment, the cover head 150 covers the surrounding area of the nozzle openings 21 of the nozzles plate 20. A surface of the nozzles plate 20 to which the nozzle openings 21 are open through the cover head 150 is referred to as the liquid ejection surface 22.

An elastic film 50 is disposed on a surface of the flow path forming substrate 10 which is opposite to the nozzles plate 20, and an insulator film 55 is disposed on the elastic film 50. Further, first electrodes 60, piezoelectric layers 70 which are piezoelectric material that perform electromechanical conversion and second electrodes 80 are stacked on the insulator film 55 in sequence and constitute piezoelectric actuators 300 which are pressure generating means of this embodiment. Accordingly, each piezoelectric actuator 300 includes the first electrode 60, the piezoelectric layer 70 and the second electrode 80. In general, one of the electrodes of the piezoelectric actuator 300 is used as a common electrode, and the other of the electrodes and the piezoelectric layer 70 are patterned for each of the pressure generating chambers 12. Further, a portion which is formed by one of the electrodes and the piezoelectric layer 70 which are patterned and has a piezoelectric strain due to application of a voltage to both electrodes is referred to as a piezoelectric active portion. In this embodiment, the first electrode 60 on the side of the flow path forming substrate 10 is used as the common electrode of the piezoelectric actuator 300, and the second electrode 80 is used as an individual electrode of the piezoelectric actuator 300, although the first electrode 60 and the second electrode 80 may be used as the individual electrode and the common electrode, respectively, for convenience of the drive circuit and wiring. In the above example, the elastic film 50, the insulator film 55 and the first electrode 60 are configured to serve as a vibration plate. However, the invention is not limited thereto, and for example, a configuration is possible in which only the first electrode 60 serves as the vibration plate without the elastic film 50 and the insulator film 55. Alternatively, the piezoelectric actuator 300 itself may substantially serve as the vibration plate.

Each second electrode 80 which is the individual electrode of the piezoelectric actuator 300 is connected to a lead electrode 90 (connection terminal) that extends to the insulator film 55. The lead electrode 90 has one end that is connected to the second electrode 80 and the other end that extends to a position between the rows of the piezoelectric actuators 300. That is, the other end of the lead electrode 90 extends to a position between the piezoelectric actuators 300 which are adjacent in the second direction Y. The other end of the lead electrode 90 is connected to the drive wiring 101.

The protective substrate 30 that has the manifold sections 31 which form at least part of the manifolds 100 is attached on the flow path forming substrate 10 which has the piezoelectric actuators 300, that is, on the first electrodes 60, the insulator film 55 and the lead electrodes 90, via an adhesive 35. In this embodiment, the manifold sections 31 extend in the width direction of the pressure generating chambers 12 and penetrate the protective substrate 30 in the thickness direction. The manifold sections 31 communicate with the communication sections 13 of the flow path forming substrate 10 as described above so as to form the manifold 100 which serve as the common ink chamber of the pressure generating chambers 12. Although the communication sections 13 which form the manifolds 100 are disposed on the flow path forming substrate 10 in this embodiment, the invention is not limited thereto. For example, the communication sections 13 of the flow path forming substrate 10 may be separated for each of the pressure generating chambers 12 so that only the manifold sections 31 serve as the manifold. Further, for example, only the pressure generating chambers 12 may be formed on the flow path forming substrate 10 and the ink supply paths 14 that connect the manifolds and the pressure generating chambers 12 may be disposed on a member located between the flow path forming substrate 10 and the protective substrate (for example, the elastic film 50, the insulator film 55 and the like).

Further, piezoelectric actuator holding section 32 are disposed on the protective substrate 30 at positions opposite the piezoelectric actuators 300. The piezoelectric actuator holding sections 32 are spaces that do not interfere with the movement of the piezoelectric actuators 300. The piezoelectric actuator holding sections 32 may or may not be closed as long as having spaces that do not interfere with the movement of the piezoelectric actuators 300. In this embodiment, since two rows of the piezoelectric actuators 300 are disposed, the piezoelectric actuator holding sections 32 are provided for each of the rows of the piezoelectric actuators 300. That is, two rows of the piezoelectric actuator holding sections 32 are arranged in the second direction Y on the protective substrate 30.

The protective substrate 30 also has a through hole 33 that penetrates the protective substrate 30 in the thickness direction. In this embodiment, the through hole 33 is disposed between two piezoelectric actuator holding sections 32 such that the vicinity of the end of the lead electrodes 90 which are led out from the piezoelectric actuator 300 are exposed in the through hole 33.

A drive circuit 102 such as a drive IC that actuates the piezoelectric actuators 300 is mounted on the flexible drive wiring 101. That is, the drive wiring 101 is formed of a COF or the like on which the drive circuit 102 is mounted.

As shown in FIGS. 9A and 9B, a compliance substrate 40 which is composed of a sealing film 41 and a fixation plate 42 is attached on the protective substrate 30. The sealing film 41 is made of a flexible material having a low rigidity (for example, polyphenylene sulfide (PPS) film) and closes one side of the manifold sections 31. The fixation plate 42 is made of a rigid material such as a metal (for example, stainless steel (SUS)). Since regions of the fixation plate 42 which oppose the manifolds 100 are openings 43 that penetrate the fixation plate 42 in the thickness direction, one side of the manifolds 100 is sealed by only the flexible sealing film 41. Further, the compliance substrate 40 has introduction ports 44 that supply ink to the manifolds 100 and discharge ports 45 that discharge ink from the manifolds 100. The introduction ports 44 and the discharge ports 45 are disposed at each end of the manifold sections 31 of the manifolds 100 in the first direction X.

A head case 105 is mounted on the compliance substrate 40. The head case 105 has relief sections 106 in a concave shape at positions which correspond to the openings 43 so as to allow the openings 43 to flexibly deform as appropriate. Further, the head case 105 has an insertion hole 107 that communicates with the through hole 33 of the protective substrate 30. The drive wiring 101 is inserted into the insertion hole 107 and the through hole 33 with the lower end of the drive wiring 101 being connected to the lead electrodes 90.

The head case 105 also has third supply paths 202 that communicate with the introduction ports 44 and supply ink from the second supply paths 201 of the flow path member 120 to the manifolds 100, and third discharge paths 212 that communicate with the discharge ports 45 and discharge ink to the second discharge paths 211 of the flow path member 120. That is, as shown in FIG. 2, in this embodiment, each supply path that supplies ink from the liquid storing unit 6 to the manifold 100 includes the first supply path 200 of the supply tube 7, the second supply path 201 of the flow path member 120, the third supply path 202 of the head case 105 and the introduction port 44. Further, each discharge path that discharges ink from the manifold 100 to the liquid storing unit 6 includes the discharge port 45, the third discharge path 212 of the head case 105, the second discharge path 211 of the flow path member 120 and the first discharge path 210 of the discharge tube 8.

In this embodiment, the flow path resistance of the discharge flow path from the manifold 100 is smaller than the flow path resistance of the supply flow path from the pump unit 9 to the manifold 100.

The flow path resistance of the discharge flow path in this embodiment is a flow path resistance of the discharge path (the entire discharge path) that discharges ink from the manifolds 100 of the respective ink jet recording heads 2 to the liquid storing unit 6. In the case where the discharge path is not connected to the liquid storing unit 6 and ink is discharged to the outside or the like, the flow path resistance of the discharge path is a flow path resistance to the discharge port.

The flow path resistance of the supply flow path is a flow path resistance of a portion of the supply path that supplies ink from the liquid storing unit 6 to the manifolds 100 which extends from the pump unit 9 to the manifolds 100.

That is, in this embodiment, the flow path resistance (pressure loss) of the discharge path (the entire discharge path) that discharges ink from the manifolds 100 of the respective ink jet recording heads 2 to the liquid storing unit 6 is smaller than the flow path resistance (pressure loss) of a portion of the supply path that supplies ink from the liquid storing unit 6 to the manifolds 100 which extends from the pump unit 9 to the manifolds 100.

More specifically, as described above, the discharge path (the entire discharge path) that discharges ink from the manifolds 100 to the liquid storing unit 6 refers to the discharge port 45, the third discharge path 212, the second discharge path 211 and the first discharge path 210. Further, the supply path which extends from the pump unit 9 to the manifolds 100 refers to a portion of the first supply path 200 which extends from the pump unit 9 to the ink jet recording heads 2, the second supply path 201, the third supply path 202 and the introduction port 44. In this embodiment, the filter 124 that traverses the flow path is disposed at a position in the supply path between the pump unit 9 and the manifolds 100, more specifically, in the second supply path 201. Accordingly, the filter 124 causes the flow path resistance of the supply path which extends from the pump unit 9 to the manifolds 100 to be larger than that of the discharge path.

As a matter of course, adjustment of the flow path resistance is not limited to the use of the filter 124. The flow path resistance of the discharge path may be adjusted to be smaller than the flow path resistance of the supply path which extends from the pump unit to the manifolds by adjusting the cross-sectional area of the flow path. That is, the flow path resistance of the discharge path may be smaller than the flow path resistance of the supply path by increasing the cross-sectional area of the discharge path to be larger than the cross-sectional area of the supply path. In addition, both the pressure loss of the filter 124 and the cross-sectional area of the flow path can be adjusted, or alternatively, the flow path resistance can be adjusted by using any other methods.

Accordingly, when the flow path resistance of the discharge path from the manifolds 100 to the liquid storing unit 6 is smaller than the flow path resistance of the supply path from the pump unit 9 to the manifold 100, the pressure in the manifolds 100 can be stabilized by preventing the pressure in the manifolds 100 from varying even if the amount of ink droplets ejected from the nozzle openings 21 changes. In other words, in one ink jet recording head 2, the consumption of ink differs between when ink droplets are ejected from one nozzle opening 21 and when ink droplets are ejected from all the nozzle openings 21. If the flow path resistance of the discharge path is large, the pressure in the manifolds 100 varies depending on the consumption of ink ejected at a time. Accordingly, the pressure change in the manifolds 100 due to the difference in the consumption of ink causes the difference in the weight of ejected ink droplets, which causes uneven ink application (uneven printing) on the recording sheet S. In particular, in the nozzle openings 21 that eject the ink droplets of the same color, the difference in the weight of ejected ink droplets often causes streaky unevenness of ink application. In this embodiment, the pressure change in the manifolds 100 due to the difference in the consumption of ejected ink can be reduced by decreasing the flow path resistance of the discharge path. Accordingly, the difference in the weight of the ejected ink droplets can be reduced regardless of the number of nozzle openings 21 that eject ink droplets at a time. As a result, the uneven ink application on the recording sheet S can be prevented.

The ink jet recording heads 2 are arranged such that the arrangement direction of the nozzle openings 21, the first direction X, is perpendicular to the transportation direction of the recording sheet S. The rows of the nozzle openings 21 are continuous in the arrangement direction of the ink jet recording head 2. Since the rows of the nozzle openings 21 of the plurality of ink jet recording heads 2 are positioned to be continuous in the direction that is perpendicular to the transportation direction, it is possible to perform printing on the recording sheet S having a large width by using the nozzle rows of short length. In this embodiment, the first supply path 200 of the supply tube 7 that supplies ink in the liquid storing unit 6 is divided into branches so that ink of the same color (the same type liquid) is supplied to the plurality of ink jet recording heads 2. That is, in the line-type ink jet recording apparatus I of this embodiment in which the nozzle openings 21 are arranged to be continuous in the direction that is perpendicular to the transportation direction of the recording sheet S and ink of the same color (the same type liquid) is supplied to the plurality of ink jet recording heads 2, the difference in the pressure in the manifolds 100 of the different ink jet recording heads 2 can be reduced by decreasing the flow path resistance of the discharge path as described above, thereby reducing the difference in the weight of ink and preventing the streaky unevenness of ink application which occurs particularly during ejection of the ink of the same color.

Further, in this embodiment, ink which is pressurized by the pump unit 9 is supplied to the ink jet recording heads 2. Accordingly, ink can be supplied under a higher pressure than in the case where ink is supplied from the liquid storing unit 6 to the manifold 100 under a negative pressure by using a suction pump or the like which is disposed in the discharge path. That is, a meniscus at the nozzle opening 21 may be broken by a high suctioning pressure when ink is supplied by suctioning (under a negative pressure), while ink can be supplied under a high pressure when ink is supplied by pumping (under a positive pressure). Accordingly, when ink is supplied under a relatively high pressure by using a pump unit 9, air bubbles attached on the filter 124 can be discharged. Therefore, the ink jet recording head 2 can be reduced in size by decreasing an effective area of the filter 124.

Other Embodiments

Although one embodiment of the invention has been described above, the essential configuration of the invention is not limited to the above-mentioned embodiment.

Figure 10:
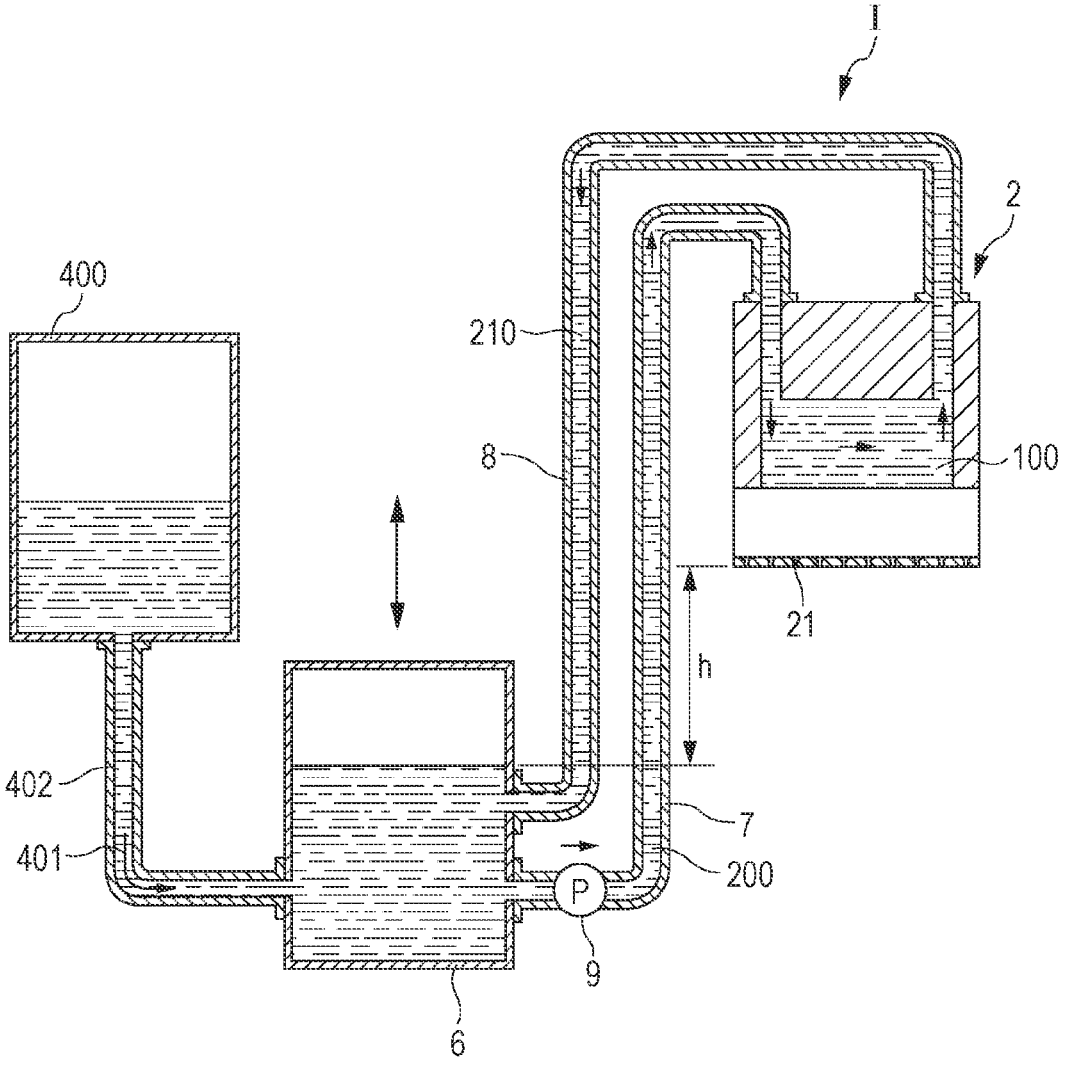
FIG. 10 is a sectional view which shows a schematic configuration of a recording apparatus according to other embodiments.

For example, a refilling unit may be provided so as to refill ink into the liquid storing unit of the first embodiment. An example of the refilling unit is shown in FIG. 10. FIG. 10 is a sectional view which shows a schematic configuration of the ink jet recording apparatus.

As shown in FIG. 10, the ink jet recording apparatus I of this embodiment includes the ink jet recording head 2, the liquid storing unit 6 that stores ink and a refilling unit 400 that refills liquid into the liquid storing unit 6.

The liquid storing unit 6 is configured to store ink and is movable upward and downward in the vertical direction relative to the ink jet recording head 2. Although not shown in the figure, a moving unit that moves the liquid storing unit 6 upward and downward in the vertical direction is also provided. The moving unit includes, for example, a device that uses a motor, hydraulic pressure and electromagnetic force.

The refilling unit 400 is provided as a storage tank or the like that stores ink and supplies ink to the liquid storing unit 6. Specifically, the refilling unit 400 is connected to the liquid storing unit 6 via a refilling tube 402 having a refilling path 401 in the refilling tube 402. The refilling unit 400 refills the liquid storing unit 6 with ink when ink is consumed by being ejected as ink droplets from the ink jet recording head 2. Although not shown in the figure, a liquid level sensor that detects ink consumption in the liquid storing unit 6, a valve that opens/closes the refilling path 401 in response to the information from the liquid level sensor are also provided.

In the ink jet recording apparatus I, the moving unit moves the liquid storing unit 6 upward and downward in the vertical direction relative to the ink jet recording head 2. This changes a height h from the liquid level of the ink stored in the liquid storing unit 6 to the liquid ejection surface to which the nozzle openings of the ink jet recording head 2 are open, which causes a change in water head pressure and a change in negative pressure during discharge from the manifolds 100 to the liquid storing unit 6. Accordingly, the position of liquid meniscus at the nozzle openings 21 can be adjusted by adjusting the pressure in the manifold 100.

Then, when ink is consumed by being ejected as ink droplets from the ink jet recording head 2, ink is refilled into the liquid storing unit 6 by the refilling unit 400.

In the configuration shown in FIG. 10, the pressure change in the manifolds 100 can be reduced by decreasing the flow path resistance of the discharge path to be smaller than the flow path resistance of the supply path which extends from the pump unit 9 to the manifolds 100, thereby reducing the difference in the weight of ejected ink droplets. As a matter of course, a moving unit may be provided in the liquid storing unit 6 of the first embodiment. In the example shown in FIG. 10, ink meniscus at the nozzle opening 21 is adjusted by using the water head difference when the moving unit moves the liquid storing unit 6 upward and downward in the vertical direction, although the invention is not limited thereto. For example, the meniscus may be adjusted by a pressure of a negative pressure pump which is provided at a position in the discharge path, or a water level in the liquid storing unit 6 may be detected by using a sensor so that refilling unit 400 refills the liquid storing unit 6 with ink in response to decrease of the water level.

In the first embodiment, the circulation flow path is described in which ink in the liquid storing unit 6 is supplied to the ink jet recording heads 2 through the supply path and ink supplied to the ink jet recording heads 2 is discharged in the same liquid storing unit 6, although the invention is not limited thereto. For example, a supply liquid storing unit for storing ink to be supplied and a discharge liquid storing unit for storing ink to be discharged may be separately provided. Alternatively, the discharged ink may be disposed, not being stored. In addition, the circulation flow path can be formed by connecting the supply liquid storing unit and the discharge liquid storing unit.

In the first embodiment, the pressure generating unit that generates a pressure change in the pressure generating chamber 12 has been explained as a thin film type piezoelectric element 300, although the pressure generating unit is not specifically limited thereto. For example, a thick film type piezoelectric actuator that is formed by bonding a green sheet or a vertical vibration-type piezoelectric actuator that is formed by alternately stacking a piezoelectric material and an electrode forming material so as to expand and contract in the axial direction can also be used. Further, as a pressure generating unit, a heat generating element may be disposed in the pressure generating chamber so as to generate bubbles by heat from the heat generating element, thereby ejecting liquid droplets from the nozzle openings, or a so-called static actuator may be used to generate static electricity between the vibration plate and the electrode so as to deform the vibration plate by electrostatic force, thereby ejecting liquid droplets from the nozzle openings.

In the first embodiment, the ink jet recording apparatus I has been described as a so-called line type recording apparatus in which the ink jet recording head 2 (head unit II) is mounted at a fixed position on the apparatus body 4 and printing is performed only by transporting the recording sheet S, although the ink jet recording apparatus I is not limited thereto. For example, the invention can be applied to a so-called serial type ink jet recording apparatus in which the ink jet recording head (head unit II) is mounted on the carriage that moves in the main scan direction which is perpendicular to the transportation direction of the recording sheet S so that printing is performed while the ink jet recording head 2 moves in the main scan direction.

Further, the invention is directed to the liquid ejecting apparatuses in general. For example, the invention can be applied to liquid ejecting apparatuses which use recording heads such as various ink jet recording heads used for image recording apparatuses such as a printer, color material ejecting heads used for manufacturing color filters for liquid crystal displays and the like, electrode material ejecting heads used for forming electrode for organic EL displays, field emission displays (FED) and the like, and bioorganic ejecting heads used for manufacturing bio chips and the like.

What is claimed is:

1. A liquid ejecting apparatus comprising:

a liquid ejecting head that ejects liquid in a manifold as liquid droplets from nozzle openings;

a supply path that supplies the liquid to the manifold;

a pump unit that is disposed in the supply path and pumps the liquid to the manifold; and a discharge path that discharges the liquid from the manifold, wherein a flow path resistance of the discharge path from the manifold is smaller than a flow path resistance of the supply path between the pump unit and the manifold to reduce pressure change in the manifold due to difference in number of the nozzle openings ejecting liquid at a time.

2. The liquid ejecting apparatus according to claim 1, further comprising a filter that traverses the supply path is disposed in the supply path at a position between the pump unit and the manifold.

3. The liquid ejecting apparatus according to claim 1, wherein the flow path resistance is adjusted by adjusting an amount of cross-sectional area of the supply path and the discharge path.

4. The liquid ejecting apparatus according to claim 1, further comprising a liquid storing unit, wherein the pump unit pumps the liquid stored in the liquid storing unit via the supply path, and the discharge path discharges the liquid from the manifold to the liquid storing unit.

5. The liquid ejecting apparatus according to claim 1, further comprising a supply liquid storing unit, wherein the pump unit pumps the liquid stored in the supply liquid storing unit via the supply path.

6. The liquid ejecting apparatus according to claim 5, further comprising a discharge liquid storing unit, wherein the discharge path discharges the liquid from the manifold to the discharge liquid storing unit.

7. The liquid ejecting apparatus according to claim 6, wherein the supply liquid storing unit and the discharge liquid storing unit are connected with each other.

8. The liquid ejecting apparatus according to claim 1, further comprising a plurality of liquid ejecting heads, wherein the supply path that supplies the liquid from the pump unit to the liquid ejecting head is divided into branches.

9. The liquid ejecting apparatus according to claim 1, wherein the pump unit is a pump.

10. The liquid ejecting apparatus according to claim 1, wherein pressure adjustment of a liquid meniscus at the nozzle opening is performed by using a water head difference between a liquid ejection surface to which the nozzle opening is open and the liquid storing unit.

11. The liquid ejecting apparatus according to claim 1, further comprising a filter disposed in the supply path at a position between the pump unit and the manifold, wherein the filter increases the flow path resistance from the pump unit to the manifold relative to the flow path resistance downstream of the manifold.

12. The liquid ejecting apparatus according to claim 1, wherein a relatively constant liquid pressure is maintained in the manifold.

* * * * *